United States Patent [19]

Hambly et al.

[11] Patent Number: 5,021,020

[45] Date of Patent: Jun. 4, 1991

[54] FLAT TOY DOLL AND FLAT TOY DOLL AND FOLIO SYSTEM

[76] Inventors: Pauline Hambly, 532 Hixville Rd.; Ann Frias, 51 State Rd., both of No. Dartmouth, Mass. 02747

[21] Appl. No.: 480,228

[22] Filed: Feb. 15, 1990

[51] Int. Cl.[5] ..... A63H 3/00; A63H 3/08; A63H 3/02

[52] U.S. Cl. ..... 446/73; 446/98; 446/370

[58] Field of Search ..... 446/73, 72, 75, 97, 446/98, 369, 370, 372, 474, 901

[56] References Cited

U.S. PATENT DOCUMENTS

| | | | |
|---|---|---|---|
| 1,405,134 | 1/1922 | Hoyme | 446/73 X |
| 1,479,252 | 1/1924 | Richards | 446/73 X |
| 2,079,550 | 5/1937 | DeMott | 446/98 |
| 3,955,309 | 5/1976 | Noble | 446/370 |
| 4,066,261 | 1/1978 | Stewart | 273/DIG. 4 X |
| 4,122,628 | 10/1978 | Crowell et al. | 446/98 X |

FOREIGN PATENT DOCUMENTS

| | | | |
|---|---|---|---|
| 425576 | 10/1947 | Italy | 446/370 |
| 1571352 | 7/1980 | United Kingdom | 446/370 |
| 2197800 | 6/1988 | United Kingdom | 446/370 |

*Primary Examiner*—Robert A. Hafer
*Assistant Examiner*—D. Neal Muir
*Attorney, Agent, or Firm*—Thomas A. Kahrl

[57] ABSTRACT

An improved flat doll, a combination flat doll and folio system and a method of constructing a flat doll. The flat doll comprises a figure in silhouette form of disproportionate thickness to width having a head, arms, legs and torso, and consisting of a wire frame to maintain shape and provide flexible resiliency for the flat doll, a front flat panel covering the front of the doll figure, a flat intermediate body form comprising a plurality of layers of flat material, a rear flat panel including loop fastener material, on to which tabs attach to the dolls clothing of one sided construction will adhere, a plurality of clothing members for dressing the flat doll by placing one sided clothes on the front of the doll figure with tabs pulled to the back of the doll on the rear panel and with these tabs constructed with hook material to be attached to the doll's back panel to securely hold the clothing in place during play, the doll having tabs constructed of hook fastener material for engaging the rear panel, and fastening the clothes to the doll by placing the one sided clothes on the front of the doll figures with the tabs pulled to the back and with these tabs constructed with hook material to be attached to the dolls back panel to securely hold the clothes in place during play, and the folio system constructed in the form of a book comprising a plurality of covers constructed of loop fabric material and a plurality of fabric pages also constructed of loop fastener material to which a doll figure may be attached by cooperation of the loop material on the back panel of the doll and the loop fastener material on the pages and for attaching a wardrobe consisting of a plurality of one sided clothes having tabs with hook material for cooperation with the loop material of pages.

8 Claims, 3 Drawing Sheets

FLAT TOY DOLL AND FLAT TOY DOLL AND FOLIO SYSTEM

BACKGROUND OF THE INVENTION

Flat paper dolls have been very popular for children for many years as they provide a variety of paper figures and paper wardrobe to dress the figures with at a very modest cost. However traditional paper dolls have the disadvantages that the paper clothes constructed to be attached by tabs extending out from the edges tear easily and thereby permit the clothes to tear or fall off because the tabs would not hold when the doll was moved during play. Flat paper dolls also would not stand up nor could the arms or legs be manipulated by the user to assume a life like pose in an imaginary play theme. Furthermore, typically conventional three dimensional dolls are difficult for children to dress and undress because of the manual dexterity needed to get the dolls arms and the legs in and out of the clothing. This leads to frustration on the part of the child leading to disinterest or damage and discard of the toy. This frustration can be eliminated by the present invention incorporating a flat doll construction because flat clothes can be put on the doll and stick easily thus eliminating frustration often encountered when trying to dress and undress the traditional doll.

SUMMARY OF THE INVENTION

The present invention is directed to providing an improved one-sided flat doll of substantial thickness which gives the appearance of roundness to a flat doll, a folio wardrobe system employing the improved flat doll and wardrobe and to a method for constructing the improved flat doll employing the improved construction of the invention.

The flat doll apparatus and flat doll wardrobe for including a plurality of articles of apparel are particularly adapted to provide for ease of dressing and changing clothes outfits of a doll by small children, and by having a thickened figure with an inner frame provides a pleasing life like appearance. The present invention comprises a flat doll which includes a thickened flat figure of an animate human object shaped in a silhouette form of disproportionate thickness to width, having a head, a plurality of arm members, a plurality of leg members, and a torso.

The figure of the doll is of multilayer construction and includes a plastic coated flexible wire for providing a flexible frame for the figure wherein the sharp ends of the wire have been twisted and bent inwardly against the wire to eliminate any sharp protrusions which might otherwise harm or injure the user. An inner body form constructed of polyester fleece is provided immediately adjacent the wire frame and is attached thereto by stitching. An intermediate body form of polyester fleece is attached on top of the inner body form by means of outline stitching extending through both body forms to give the figure firmness. One side of the intermediate body form is covered by a thin layer of polyester fiber. A substantially flat front outer panel on which a face and hair has been painted with individualized features, consisting of knit fabric covering the entire front surface of the doll figure, is stretched over the multilayer body form and the outer peripheral edges are drawn together on the back, and secured by stitching. Fastening means for attaching clothing to be worn by the doll comprising a rear panel slightly smaller than the figure as attached to the back of the intermediated body form comprising a layer of looped pile fleece.

The figure then includes a fastener means attached to the back of the head and neck of the figure for attaching to a support member such as a stand or wall.

The portfolio then includes pages for holding clothing means for dressing the doll in a plurality of outfits comprising a essentially flat one dimensional garment sized to fit the doll figure provided with a plurality of tabs extending outwardly from opposite sides of the garment having hook fastener means attached thereto for easy, quick and secured attachment with a loop pile fleece layer of the bank panel.

The flat doll and apparel system for providing convenient and orderly storage for a multiplicity of apparel outfits to dress the flat doll, comprises a folio fabric book, having a pair of covers constructed of loop fabric and a plurality of pages constructed of loop fabric. The doll figure can be attached for storage in the portfolio on a first page by pressing the back panel consisting of a strip of hook fasteners secured to the head and neck against the surface of the first page constructed of loop pile fleece for attachement thereto subject to release by the user when desired. A garment element can be attached to a second page of the fabric portfolio comprised of loop pile fabric by pressing the tabs of the garment including hook fastener means against the surface of the fabric pages.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DESCRIPTION OF THE EMBODIMENTS

Figure 1:
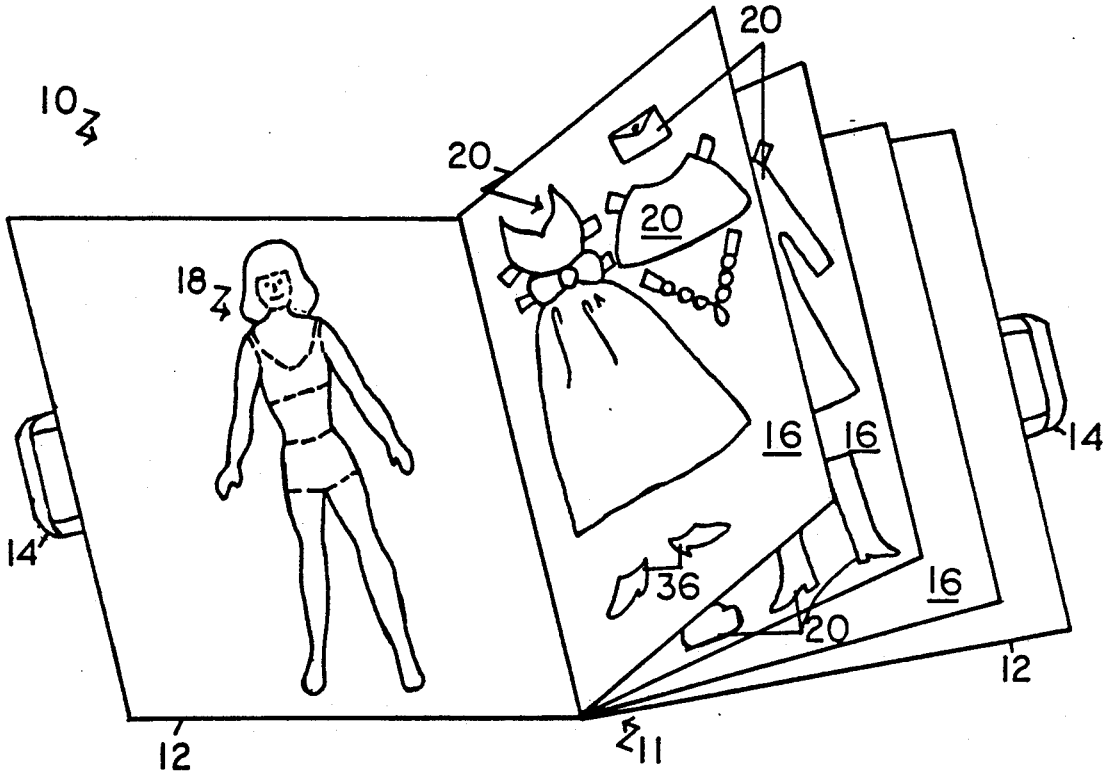
FIG. 1 is a perspective view of the folio book and the doll of the invention together with apparel for dressing the doll.

With reference to the dreawings, FIG. 1 shows a doll folio system 10, comprising a flat doll 18, a folio 11, comprising a plurality of cover pages constructed of loop fastener fabric 12 with handles 14, a plurality of pages constructed of loop fastener fabric 16, and including the flat doll 18 mounted on a cover page 12 and a doll wardrobe 20 mounted on a plurality of pages 16 therein for dressing the flat doll 18.

Figure 2:
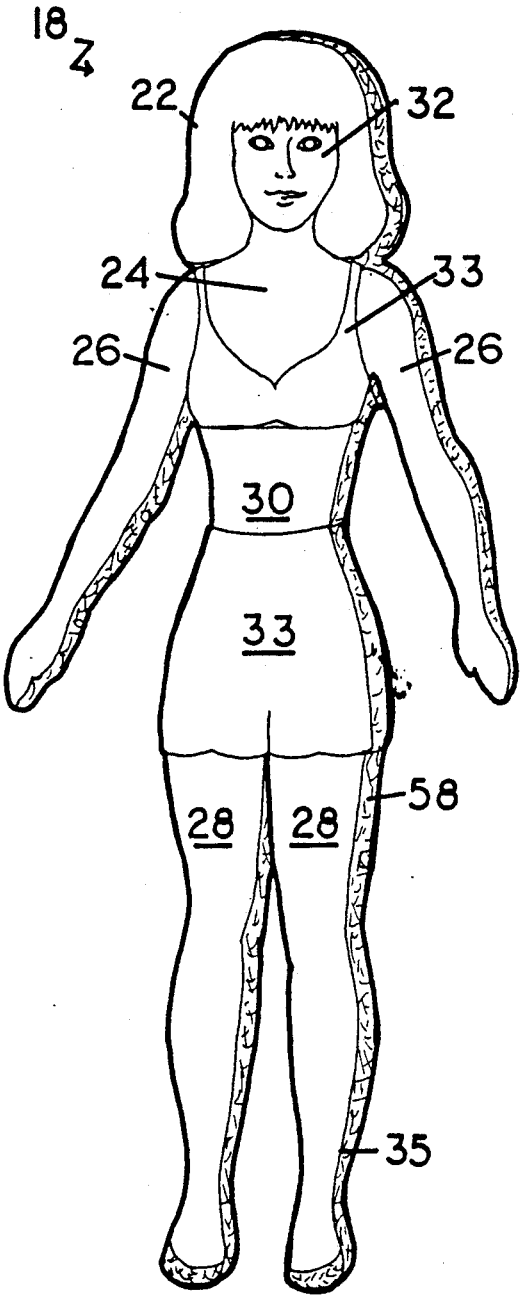
FIG. 2 is a front view of the toy doll of the invention.
Figure 4:
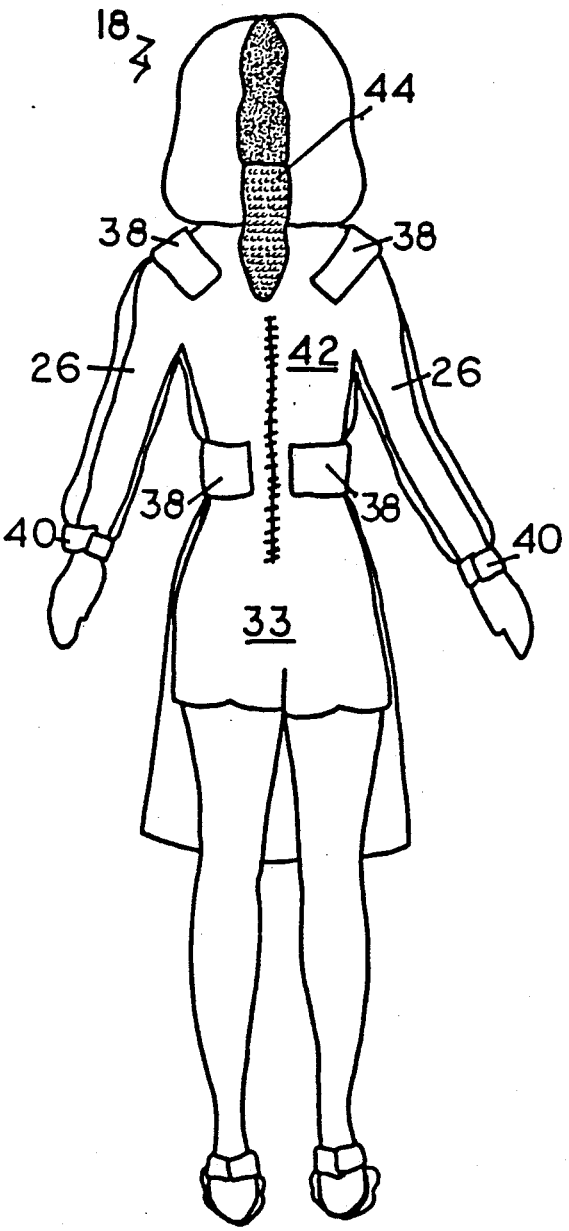
FIG. 4 is a back view of the toy doll of the invention as employed in Fig. 3.

As shown in FIGS. 2 & 4 the flat doll 18 is shaped in silhouette form of disproportionate thickness to width having a head member 22, a torso portion 24, a plurality of arms 26, a plurality of legs 28 and having a front panel 30 extending the entire length of the front of the figure of the flat doll consisting of a flat layer of soft washable fabric. Imprinted on the front panel are individualized facial features 32 on the head 22, and undergarments 33 on the torso 24. A rounded outer edge 35 is disposed between the front panel 30 and a rear panel 42.

Figure 3:
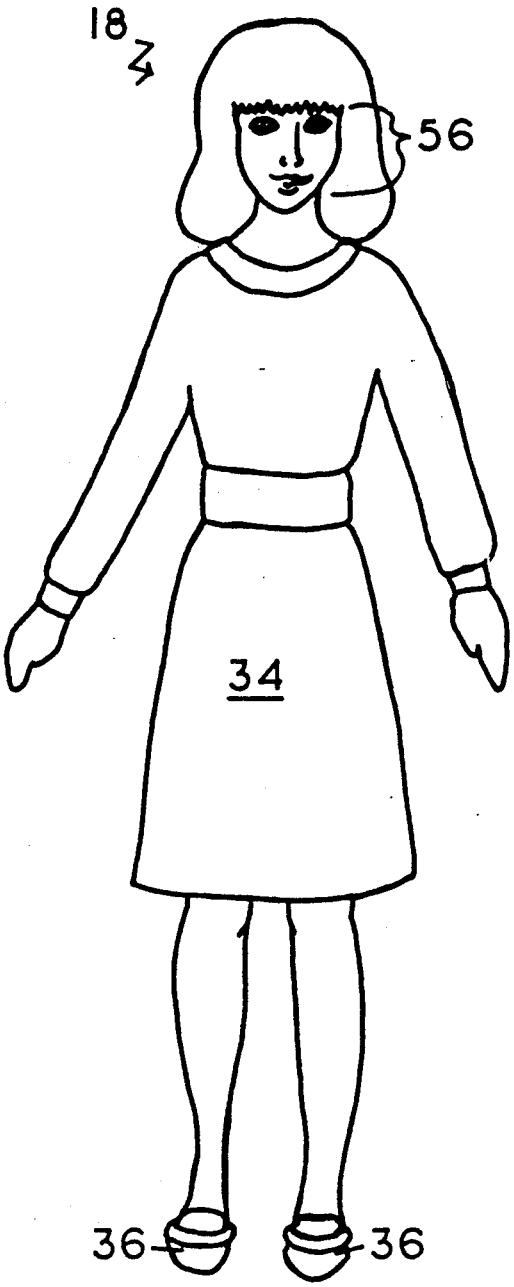
FIG. 3 is a front view of the toy doll of the invention as shown in FIG. 2 dressed with an article of clothing.

As shown in FIGS. 2, 3 & 4 an essentially flat, 2 dimensional, article of clothing, here shown as a dress 34 and a pair of shoes 36 has been affixed to the torso portion 24 of the figure. The dress 34 is provided with a plurality of tabs 38 constructed of the hook section of a hook and loop fastening material and a plurlity of wrist tabs 40, also of hook material for engaging the wrist portion of the arms 26. The rear panel 42 extends over the entire length of the rear of the figure of the flat doll 18 and consists of a flat layer of loop fastening material. Affixed to the back of the head member 22 and neck portion of a fastener tab 44 for attaching to a support member, not shown, such as a stand or a wall or for attaching the doll figure 18 to the one of the plurality of fabric pages 16 in a folio book.

Figure 5:
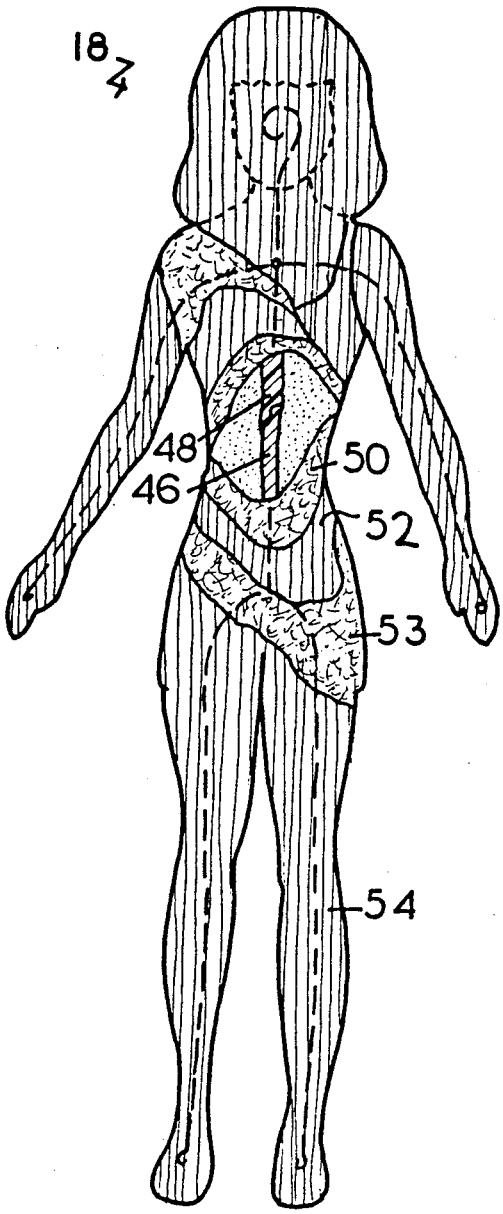
FIG. 5 is a front view of the toy doll as shown in FIG. 2 partially in sections showing the wire frame and layers of inner and intermediate body forms.

As shown in FIG. 5, the flat doll 18 has a composite construction comprising a skeletal wire frame 46 in the interior of the figure having a flexible plastic coating 48 to which is fastened an inner body form 50 constructed of polyester fleece. An intermediate body form 52, also consisting of polyester fleece is positioned on the inner body form 50 and fastened thereto. A panel 53 constructed of polyester fleece is attached to the front of the intermediate body form 52 and extends over the entire front of the figure including the multiple layers of the inner and intermediate body forms to which is attached a next polyester fiber layer. A front panel 54 covering panel 53 consists of flesh colored knit fabric onto which a unique face 56 has been individually painted. The rear panel 42 of the doll figure is constructed of a flat layer of loop fastening mateial extending over the entire surface of the rear of the flat doll 18.

The doll wardrobe 20 as shown if FIG. 1 includes a plurality of articles of apparel to be selected by the user for dressing the doll.

The method of constructing the substantially flat doll 18 includes forming a skeletal wire frame 46 with a plastic coating 48 to provide an inner frame by coiling and twisting the wire so that all sharp points or ends are eliminated. The next step includes winding padding around the coiled wire to form the inner body form 50 consisting of polyester fleece which is then stitched to the wire frame. Next a second intermediate body form 52 also of polyester fleece, is outline stitched through both body forms to give the figure of the doll 18 firmness. A thin layer of polyester fabric is next attached by adhesive means on the front of the doll figure.

The front panel 30 consisting of a flesh colored knit fabric on to which a face and hair has been painted is stitched to the intermediate body form 52 of the fleece fabric leaving the center back open and turning the casing right side out and pulled onto the body form molding the knit fabric over the soft underside of the intermediate form, the back is then pulled together and secured with stitches.

Next there is provided on the flat rear panel of the doll a fastener tab 44 made of fabric with the hook part of a fastener stitched on the tab being used to hold the doll 18 onto another surface or to apply a covered piece or cardboard or plastic of proper length thus allowing the doll 18 to stand alone.

Thereafter sewing or painting on the front of the front panel 54 which now has a flat but rounded appearance undergarments 33 and then making stitches taken at the chin, shoulder, elbow, wrist, waist, knee, and ankle, giving the doll 18 dimension and shoes 36 of loop pile are attached thus allowing other footwear to be placed on with ease.

What is claimed is:

1. A substantially flat doll apparatus to be dressed by the user which apparatus comprises in combination;

(a) a figure of an animate object shaped in silhouette form of disproportionate thickness to width, constructed of a plurality of flat layers of fabric material, having a head member, a plurality of arm members, a plurality of leg members and a torso comprising;

(i) a flexible wire means for providing a flexible frame for the figure and for providing for positioning of the figure;

(ii) an essentially planar front panel constructed of a layer of fabric and covering the entire front surface of the flat doll having an outer peripheral edge in the form of a doll silhouette;

(iii) a essentially planar back panel covering an entire rear of the figure constructed of a flat layer of loop fastener fabric covering the entire rear surface of the doll figure;

(iv) an intermediate body formed consisting of a plurality of flat layers of material disposed intermediate the front planar panel and the back planar panel having an outer peripheral edge in the form of a doll silhouette for providing firmness to the flat doll and for permitting flexing of the figure;

(v) a fabric fastening means extending around the outer peripheral edge of the front planar panel and rear planar panel for providing a rounded outer edge extending around the outer periphery of the doll figure;

(b) a plurality of essentially planar clothing members having tab fastener means comprising the hook section of a hook and loop fastener for dressing the figure to be selected by a user wherein the tab fastener means extends outwardly and rearwardly for engagement with the rear panel and for secure attachement of the clothes to the doll figure during play;

2. The doll apparatus of claim 1 wherein the front panel consists of a soft washable fabric imprinted with individualized face, facial features and hair features.

3. The doll apparatus of claim 1 wherein the flexible wire means consists of a plastic coated wire constructed to be substantially flat.

4. The doll apparatus of claim 1 wherein the intermediate body form comprises multiple layers of flat fleece loop material.

5. The doll apparatus of claim 1 wherein the rear panel is constructed of a flat layer of loop fastening material.

6. The doll apparatus of claim 1 wherein a support tab is attached to the flat back panel in the area of the head and neck of the figure.

7. A doll apparatus and wordrobe folio system for providing in combination a doll and wardrobe folio which doll apparatus and folio system comprises;

(a) a figure of an animate object shaped in silhouette form of disproportionate thickness to width, having a head member, a plurality of arm members, a plurality of leg members and a torso comprising;

(i) a flexible wire means for providing a flexible frame for th figure;

(ii) an inner body form constructed of polyester fleece material;

(iii) an intermediate body form constructed of a flat layer of material for providing firmness to the doll apparatus;

(iv) a front panel constucted of a flat layer of fabric covering the entire front surface of the doll apparatus;

(v) a rear panel constructed of a flat layer of fabric constructed of loop fastening means covering the entire rear of the figure for providing quick attachment and quick release of clothing members for dressing the figure;

(b) a plurality of clothing members having tab fastening means for clothing the figure to be selected by the user, (c) a folio means in the form of a book having a plurality fo fabric pages constructed of loop fastener material for attaching a flat doll and a plurality of dress members for convenient separate storage therein.

8. A doll wardrobe folio in book form having a plurality of pages for providing organized storage for substantially flat dolls as claimed in claim 1 and for flat, one-sided doll clothing also as claimed in claim 1 comprising;

(a) a front cover and rear cover having interior facing surfaces construced of loop fastener fabric means for engaging and holding the flat dolls and the flat one-sided doll clothing including loop fastening fabric means and hook fastening fabric means;

(b) a plurality of pages having first and second planar surfaces each surface constructed of loop fastener means for engaging and holding the substantially flat dolls and the flat one-sided doll clothing including loop fastening fabric and hook fastening means wherein the loop fastening surfaces of the front cover, the rear cover and the plurality of pages permits rapid engagement for storage and organization of the substantially flat dolls and flat one-sided doll clothing and rapid disengagement thereof.

* * * * *